US011124008B2

(12) United States Patent
Brehm et al.

(10) Patent No.: US 11,124,008 B2
(45) Date of Patent: Sep. 21, 2021

(54) MULTILAYER ELEMENT AND METHOD FOR PRODUCING SAME

(71) Applicant: LEONHARD KURZ Stiftung & Co. KG, Furth (DE)

(72) Inventors: Ludwig Brehm, Adelsdorf (DE); Klaus Pforte, Oberasbach (DE); Patrick Kramer, Lauf (DE); Karin Forster, Rosstal (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 141 days.

(21) Appl. No.: 15/560,788

(22) PCT Filed: Mar. 9, 2016

(86) PCT No.: PCT/EP2016/055006

§ 371 (c)(1),
(2) Date: Sep. 22, 2017

(87) PCT Pub. No.: WO2016/150704

PCT Pub. Date: Sep. 29, 2016

(65) Prior Publication Data

US 2018/0043723 A1 Feb. 15, 2018

(30) Foreign Application Priority Data

Mar. 24, 2015 (DE) ..... 102015104416.1

(51) Int. Cl.
*B42D 25/324* (2014.01)
*B41M 3/14* (2006.01)
(Continued)

(52) U.S. Cl.
CPC ..... *B42D 25/324* (2014.10); *B41M 3/14* (2013.01); *B41M 7/00* (2013.01); *B42D 25/29* (2014.10);
(Continued)

(58) Field of Classification Search
CPC ..... B41M 3/14; B42D 25/328; B42D 25/29; B42D 25/324
See application file for complete search history.

(56) References Cited

U.S. PATENT DOCUMENTS 5,270,078 A * 12/1993 Walker ..... B41C 1/003 427/264
5,292,556 A 3/1994 Ma et al.
(Continued)

FOREIGN PATENT DOCUMENTS

CN 101115627 1/2008
CN 101115627 A 1/2008
(Continued)

OTHER PUBLICATIONS

Chinese Office Action for corresponding Chinese Patent Application No. 201680028624.1, pp. 1-8 (dated Jan. 28, 2019).

*Primary Examiner* — Kelly M Gambetta
(74) *Attorney, Agent, or Firm* — Hoffmann & Baron, LLP

(57) ABSTRACT

A method for producing a multilayer body, with the steps:
a) providing a first printed layer;
b) partially applying a second printed layer to the first printed layer;
c) structuring the first printed layer using the second printed layer as a mask.
A multilayer body obtainable in this way and a security document with such a multilayer body.

23 Claims, 7 Drawing Sheets

(51) Int. Cl.

| | |
|---|---|
| ***B41M 7/00*** | (2006.01) |
| ***B42D 25/415*** | (2014.01) |
| ***B42D 25/29*** | (2014.01) |
| ***B42D 25/445*** | (2014.01) |
| ***B42D 25/36*** | (2014.01) |
| ***B42D 25/328*** | (2014.01) |
| ***B42D 25/337*** | (2014.01) |
| ***B42D 25/364*** | (2014.01) |
| ***B42D 25/373*** | (2014.01) |
| ***B42D 25/387*** | (2014.01) |
| ***B42D 25/23*** | (2014.01) |
| ***B42D 25/24*** | (2014.01) |

(52) U.S. Cl.

CPC ..... *B42D 25/328* (2014.10); *B42D 25/337* (2014.10); *B42D 25/36* (2014.10); *B42D 25/364* (2014.10); *B42D 25/373* (2014.10); *B42D 25/387* (2014.10); *B42D 25/415* (2014.10); *B42D 25/445* (2014.10); *B42D 25/23* (2014.10); *B42D 25/24* (2014.10)

(56) References Cited

U.S. PATENT DOCUMENTS

| | | | | |
|---|---|---|---|---|
| 8,053,146 | B2 | 11/2011 | Staub et al. | |
| 8,367,277 | B2 | 2/2013 | Brehm et al. | |
| 9,188,873 | B2 | 11/2015 | Shigeta et al. | |
| 2008/0095956 | A1* | 4/2008 | Brehm | B44C 1/1716 428/32.6 |
| 2011/0045248 | A1* | 2/2011 | Hoffmuller | B42D 25/342 428/156 |
| 2016/0185150 | A1 | 6/2016 | Brehm et al. | |
| 2017/0028765 | A1 | 2/2017 | Staub et al. | |

FOREIGN PATENT DOCUMENTS

| | | | | |
|---|---|---|---|---|
| CN | 101516634 | | 8/2009 | |
| CN | 101516634 | A | 8/2009 | |
| CN | 103329254 | | 9/2013 | |
| CN | 103329254 | A | 9/2013 | |
| DE | 10256491 | | 9/2003 | |
| DE | 10256491 | A1 * | 9/2003 | B41M 1/18 |
| DE | 102013106827 | | 12/2014 | |
| DE | 102013113283 | | 6/2015 | |
| EP | 0583714 | | 2/1994 | |
| JP | H02-050878 | A | 2/1990 | |
| JP | H06-219069 | A | 8/1994 | |
| JP | H06-222561 | A | 8/1994 | |

* cited by examiner

MULTILAYER ELEMENT AND METHOD FOR PRODUCING SAME

This application claims priority based on an International Application filed under the Patent Cooperation Treaty, PCT/EP2016/055006, filed Mar. 9, 2016, which claims priority to DE102015104416.1, filed Mar. 24, 2015.

BACKGROUND OF THE INVENTION

The invention relates to a method for producing a multilayer body, a multilayer body obtainable in this way as well as a security document with such a multilayer body.

In the design of security elements for banknotes, identity papers and similar security documents, it is desirable to print fine line patterns such as for example guilloche patterns. A particularly good optical impression results when such line patterns are printed multicolored, for example with color progressions or color gradients.

A known method for this is Iris printing, in which different inks are applied, neighboring each other, to a common inking roller of a printing machine. During printing, these inks are mixed, with the result that the desired color gradient forms. However, the precise progression of the gradient can scarcely be controlled, with the result that a reproducible production of identical printed motifs is scarcely possible.

A very fine structuring of a multicolored image with motif parts exactly registered relative to each other is generally scarcely possible with conventional printing processes, because the register accuracy and the edge definition are insufficient for this. In particular, multicolored fine lines are scarcely producible in this way. Added to this is the fact that fine gridded motifs dry very quickly on a gravure printing roller because of the very small quantity of ink required, and they are thereby very difficult to print.

By register accuracy is meant a positional accuracy of two or more elements and/or layers relative to each other. The register accuracy is to range within a predetermined tolerance and be as low as possible. At the same time, the register accuracy of several elements and/or layers relative to each other is an important feature in order to increase the protection against forgery. The positionally accurate positioning can be effected in particular by means of optically detectable registration marks or register marks. These registration marks or register marks can either represent specific separate elements or areas or layers or themselves be part of the elements or areas or layers to be positioned. A "perfect register" is referred to when the register tolerance is almost zero or practically zero.

SUMMARY OF THE INVENTION

The object of the present invention is to provide an improved method for producing a multilayer body with fine line patterns, such a multilayer body as well as a security document with such a multilayer body.

Such a method for producing a multilayer body comprises the steps:

a) providing a first printed layer;
b) partially applying a second printed layer to the first printed layer;
c) structuring the first printed layer using the second printed layer as a mask.

A multilayer body with a first printed layer and a second printed layer arranged on a surface of the first printed layer is thus obtained, wherein the first printed layer is structured using the second printed layer as a mask.

Such a multilayer body can be used in a security document, in particular a banknote, a security, an identity document, a visa document, a passport or a credit card, in order to increase the protection thereof against forgery.

The first printed layer can in particular be deposited flat. It is thus possible to generate a multicolored motif, for example with color transitions, color gradients or also a true-color image, without the problems described at the beginning during the printing of multicolored fine lines.

The second printed layer only acts as a mask, thus as a protective layer for the structuring of the first printed layer. The second printed layer can therefore be deposited monochromatically. In this way, fine line patterns can be generated in the second printed layer, without the problems described at the beginning occurring during the printing of multicolored fine lines.

During the subsequent structuring of the first printed layer using the second printed layer as a mask, the areas of the first printed layer which are not covered by the second printed layer are removed. The second printed layer thus covers all areas of the first printed layer, but it can even also extend beyond these. A finely structured first printed layer is thus obtained which has the fine line pattern of the second printed layer and the coloring generated during the application of the first printed layer. In particular, fine, multicolored line structures with defined edges and register accuracy can thus be generated in a reproducible manner.

It is advantageous if, to provide the first printed layer, a first varnish is used which reacts chemically, in particular in a crosslinking reaction, with a second varnish used for the application of the second printed layer. In this way, where the second printed layer is deposited the first varnish can be altered by reaction with the second varnish such that in particular it becomes resistant to chemical substances used to structure the first printed layer, such as for example etchants or solvents.

The first varnish is preferably a water-based or solvent-based alkali-soluble varnish. For example, the varnish can consist of polyacrylic acid. Such a varnish can be removed from its substrate by the treatment with an alkaline etchant. This makes the desired structuring of the first printed layer using the second printed layer as a mask possible.

It is further preferred if the first varnish comprises dyes, in particular colored or achromatic pigments and/or effect pigments, UV-excitable fluorescent pigments (UV=ultraviolet (radiation/light)), thin-film pigments, cholesteric liquid crystal pigments, dyestuffs and/or metallic or non-metallic nanoparticles. In this way, the desired color effects can be generated in visible light and/or when excited by UV light. In particular, it is expedient if the first varnish comprises several such dyes, which form color progressions, gradients, true-color images or the like.

Furthermore, it is preferred if the second varnish is a PVC mixed polymer of vinyl chloride, vinyl acetate and dicarboxylic acid. Such a varnish is resistant to alkaline etchants and can therefore act as protective varnish or as a mask for the structuring of the first printed layer with such an etchant.

Alternatively, the second varnish can also be a polyester varnish with cellulose propionate. Such a varnish also has the desired alkali resistance and can therefore be used as protective varnish.

It is further advantageous if the second varnish comprises a crosslinker, in particular polyisocyanate and/or polyaziridine. Carboxylic acid or hydroxyl groups of the two varnishes can be crosslinked with such crosslinkers, with the result that the first and second printed layers form a stable chemical bond. Where the second printed layer is applied to the first, the crosslinking makes the two printed layers stable vis-à-vis alkaline etchants and thus makes the structuring of the first printed layer possible.

It is preferred if the first printed layer is structured by the action of an alkaline etchant, in particular alkali hydroxide (NaOH) or alkali carbonate ($Na_2CO_3$). In those areas in which it is not protected by the second printed layer, the first varnish can be dissolved and removed by such etchants, with the result that the desired structuring arises.

It is advantageous if the alkaline etchant is used in a concentration of from 0.5% to 3%, and/or at a temperature of from 20° C. to 50° C., and/or for a period of from 0.5 s to 5 s. A complete removal, with defined edges, of the first printed layer can hereby be ensured in the areas in which it is not covered by the second printed layer.

Additionally, the etching process can be promoted by agitating the etchant, targeted flow of the etchant against the first printed layer, sonication, brushing and/or smearing.

The first printed layer is preferably applied multicolored, in particular in the form of a color progression, color gradient or as a true-color image.

After the structuring of the first printed layer, the desired motif then remains in the form of multicolored fine lines congruent with the second printed layer.

The first printed layer is preferably applied in the form of a grid, in particular a line grid with 60 lines/cm to 120 lines/cm and/or a line depth of from 15 μm to 45 μm. The line depth relates to the depth of the structures introduced on a printing roller, in particular on a gravure printing roller, for receiving the printing ink.

Alternatively, the first printed layer can be applied in the form of a grid, in particular a diagonally crossed grid with a grid width of from 40 ink cells/cm to 100 ink cells/cm and/or a depth of from 15 μm to 45 μm.

The first and/or second printed layer can be applied by gravure printing. In particular the above-named grids can be realized by gravure printing.

Alternatively, the first and/or second printed layer can be applied by screen printing, in particular with a mesh size of from 90 T to 140 T or 90 S to 140 S.

Grids with a minimum dot size of 75 μm and a minimum dot spacing of 10 μm can be realized both using gravure printing and using screen printing. In the case of full-tone printing, i.e. in particular during the printing of the second printed layer, a minimum line thickness of 80 μm with a minimum line spacing of 100 μm can be achieved. In all cases, the achievable register tolerance both within a grid and between the first and second printed layers is approximately 200 μm.

It is furthermore preferred if the second printed layer is applied in the form of a graphic motif, alphanumeric character, logo, image, pattern, in particular guilloche pattern. As already explained, the second printed layer defines the final form of the printed motif, while the first printed layer only determines the coloring.

It is further preferred if the first printed layer is applied to a layer composite comprising one or more of the following layers: a carrier ply, a replication layer with a surface relief, a reflective layer, a protective layer, a volume hologram layer.

As an alternative to this, it is also possible to apply to the first and/or second printed layer a layer composite comprising one or more of the following layers: a carrier ply, a replication layer with a surface relief, a reflective layer, a protective layer, a volume hologram layer.

The two options can also be combined. In this way, further security and design features can be integrated into the multilayer body in order to increase the protection thereof against forgery and manipulation and to realize particularly optically appealing designs.

It is expedient if, before the application of the layer composite, a height-compensation layer, in particular of a varnish made of a combination of butyl acrylate and PMMA with a layer thickness of from 0.5 μm to 3 μm is applied to the first and/or second printed layer. This makes sense in particular if further layers of the layer composite are applied to the first and/or second printed layer.

The mechanically relatively flexibly formed height-compensation layer levels out gradations which are formed during the structuring of the first printed layer and thus provides a smooth surface, to which the further layers can be applied cleanly.

It is furthermore advantageous if at least one layer of the layer composite is structured using the second printed layer as a mask. A further motif can hereby be formed registered relative to the second printed layer. It is thereby possible, for example, for the motif formed by the second printed layer to have a different appearance from different sides of the multilayer body.

It is particularly expedient if the at least one layer of the layer composite structured using the second printed layer as a mask is a metal layer. This makes sense in particular if the first printed layer contains UV-fluorescent dyes. A metal layer formed registered relative to the printed layers strengthens the optical effect of the printed layers under UV irradiation, as the metal layer, on the one hand, itself has a black effect under UV light and, on the other hand, reflects part of the incident UV light back into the printed layers on the rear side.

It is advantageous here if, for the structuring of the metal layer, a photoresist layer is applied to the metal layer, is exposed from the side of the second printed layer and is removed in the exposed areas during the developing. A photoresist layer perfectly registered relative to the printed layers is thus obtained, by means of which the metal layer can then be structured. The use of an external mask is not necessary.

After the developing of the photoresist layer, the metal layer is preferably structured by etching. The metal layer itself is thus structured perfectly registered relative to the printed layers.

It is further advantageous if the first and/or second printed layer comprises a UV blocker, which absorbs UV light in a wavelength range in which the photoresist layer is exposed. The effect of the printed layers as a mask for the exposure of the photoresist layer is hereby improved. The UV blocker can also be UV-fluorescent pigments provided for the optical effect of the printed layer.

Furthermore, it is expedient if the layer composite comprises at least one varnish layer with a UV blocker. This is advantageous in particular if the first printed layer contains UV-fluorescent dyes. Where the varnish layer with the UV blocker is present, no UV light reaches the first printed layer, with the result that a non-fluorescent motif recognizable under UV light can be formed in this way.

The varnish layer with the UV blocker is preferably applied in the form of a graphic motif, alphanumeric character, logo, image, pattern, in particular guilloche pattern. Such a motif can supplement or overlie, for example, a motif formed by the first and second printed layers.

As already explained at the beginning, it is advantageous if the first and second printed layers are chemically crosslinked with each other. The first printed layer hereby obtains the necessary chemical stability which makes its structuring possible, for example by etching.

It is further advantageous if the first and/or second printed layer has a layer thickness of from 1 μm to 3 μm.

The multilayer body preferably comprises a replication layer with a surface relief. In particular, it is preferred if the surface relief introduced into the replication layer forms an optically variable element, in particular a hologram, Kinegram® or Trustseal®, a preferably linear or crossed sinusoidal diffraction grating, a linear or crossed single- or multi-step rectangular grating, a zero-order diffraction structure, an asymmetrical relief structure, a blazed grating, a preferably isotropic or anisotropic mat structure, or a light-diffracting and/or light-refracting and/or light-focusing micro- or nanostructure, a binary or continuous Fresnel lens, a binary or continuous Fresnel freeform surface, a microprism structure or a combination structure thereof.

A plurality of optically variable effects that are appealing and difficult to imitate can hereby be realized.

It is further expedient if the multilayer body comprises a wax layer and/or a detachment layer. A wax layer can provide an additional protection against manipulation, in particular if it is deposited partially. If, for example, a forger attempts to loosen the layer composite, then the wax layer makes a partial detachment of the neighboring layers from each other possible. Where the wax layer is not present, the layers remain adhered to each other, with the result that the layer composite is destroyed in the case of such an attempt. A wax layer can also act as a detachment layer, which makes a detachment of a part of the layer composite from a carrier ply possible. The detachment layer can alternatively also consist of a strongly filming acrylate and/or also be part of the protective varnish layer.

Preferably, a layer thickness of the replication layer and/or of the detachment layer is 1 μm to 5 μm, preferably 1 μm to 3 μm.

It is furthermore expedient if the multilayer body comprises a detachable carrier ply, in particular made of PET (polyethylene terephthalate), PEN (polyethylene naphthalate) or BOPP (biaxially oriented polypropylene), with a layer thickness of from 6 μm to 50 μm, preferably from 12 μm to 50 μm.

Such a carrier ply protects and stabilizes the multilayer body during its production and further processing and can be removed when the multilayer body is affixed to a security document.

The multilayer body preferably comprises an at least partial metal layer, in particular made of aluminum, copper, chromium, silver and/or gold or of alloys of the above-named metals, with a layer thickness of from 5 nm to 100 nm, preferably from 10 nm to 50 nm. Such a metal layer can, on the one hand, itself form an optically appealing motif, but, on the other hand, can also act as a reflective layer to strengthen the optical impression of an optically variable element. The reflective layer is, in particular, applied directly to the surface relief of the replication layer, in particular vapor-deposited. Alternatively or additionally, the reflective layer can also be formed as an HRI layer (HRI=high refractive index), in particular made of ZnS, $TiO_2$ or $ZrO_2$.

It is furthermore preferred if the multilayer body comprises an in particular transparent protective varnish layer, in particular made of PVC, polyester, acrylate, nitrocellulose, cellulose acetate butyrate or mixtures thereof, with a layer thickness of from 0.5 μm to 10 μm, preferably from 2 μm to 5 μm. A protective varnish layer preferably forms an outer surface of the multilayer body and protects it from environmental influences, scratches and the like.

BRIEF DESCRIPTION OF THE DRAWINGS

The invention is now explained in more detail with reference to embodiment examples. There are shown in.

DETAILED DESCRIPTION OF THE PREFERRED EMBODIMENTS

Figure 3:
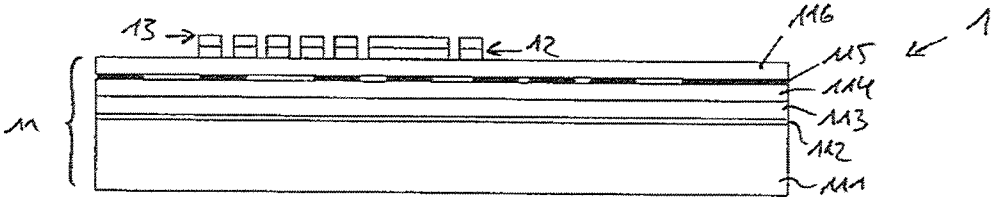
FIG. 3 an embodiment example of a multilayer body in a schematic sectional representation.

During the production of a multilayer body 1 shown as a whole in FIG. 3, a layer composite 11 is provided first of all, which comprises a carrier ply 111, a detachment layer 112, a protective layer 113, a replication layer 114, a reflective layer 115 and a further protective layer 116.

The carrier ply 111 is detachable from the layer composite 11 and in particular consists of PET (polyethylene terephthalate) with a layer thickness of from 6 μm to 50 μm, preferably from 12 μm to 50 μm.

The carrier ply 111 protects and stabilizes the multilayer body 1 during its production and further processing and can be removed when the multilayer body 1 is affixed to a security document.

The detachment layer 112 makes it possible to detach the carrier ply 111 from the rest of the layer composite 11 and consists, for example, of a wax with a layer thickness of from 50 nm to 500 nm, preferably 70 nm to 150 nm. The detachment layer can alternatively also consist of a strongly filming acrylate and/or also be part of the protective varnish layer, with a layer thickness of from 1 μm to 5 μm, preferably 1 μm to 3 μm.

The protective layers 113 and 116 form protective surfaces of the layer composite 11 and preferably consist of a clear varnish, for example of a UV-curing varnish, of PVC, polyester or an acrylate, with a layer thickness of from 0.5 μm to 10 μm, preferably 1 μm to 5 μm.

The replication layer 114 preferably consists of an acrylate with a layer thickness of from 1 μm to 5 μm, preferably from 1 μm to 3 μm.

A surface relief which forms an optically variable effect is molded into a surface of the replication layer 114. In particular, it is preferably a hologram, Kinegram® or Trustseal®, a preferably linear or crossed sinusoidal diffraction grating, a linear or crossed single- or multi-step rectangular grating, a zero-order diffraction structure, an asymmetrical relief structure, a blazed grating, a preferably isotropic or anisotropic mat structure, or a light-diffracting and/or light-refracting and/or light-focusing micro- or nanostructure, a binary or continuous Fresnel lens, a binary or continuous Fresnel freeform surface, a microprism structure or a combination structure thereof.

The metal layer 115 is at least partially deposited on the surface of the replication layer and in particular consists of aluminum, copper, chromium, silver and/or gold or of alloys of the above-named metals, with a layer thickness of from 5 nm to 100 nm, preferably from 10 nm to 50 nm.

Figure 1:
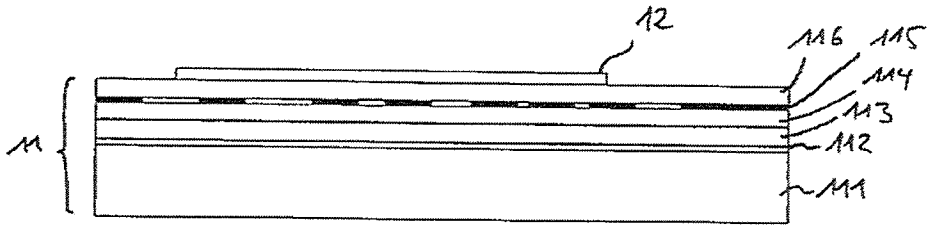
FIG. 1 a first intermediate product during the production of an embodiment example of a multilayer body in a schematic sectional representation.

As FIG. 1 shows, a first printed layer 12 is then printed flat on a surface of the protective layer 116.

A water-based or solvent-based alkali-soluble varnish is preferably used for the printing of the first printed layer 12. For example, the varnish can consist of polyacrylic acid. Such a varnish can be removed from its substrate by the treatment with an alkaline etchant. This makes a later structuring of the first printed layer 12 possible.

It is further preferred if the varnish of the first printed layer 12 comprises dyes, in particular colored or achromatic pigments and/or effect pigments, UV-excitable fluorescent pigments, thin-film pigments, cholesteric liquid crystal pigments, dyestuffs and/or metallic or non-metallic nanoparticles.

A colored pigment in a proportion of between 5% and 35%, in particular between 10% and 25%, in the varnish used for the printing of the first printed layer 12 is, for example, a UV-luminescent pigment with one or more excitation wavelengths, for example 254 nm and/or 365 nm. Such a pigment is, e.g., Lumilux Blau CD 710 (fluorescing blue at 365 nm and at 254 nm) or BF1 (from Honeywell Specialty Chemicals or Microalarm, Hungary) (fluorescing green at 365 nm, fluorescing red/orange at 254 nm). All known organic colored pigments or dyestuffs can be used for the visible spectral range.

The first printed layer 12 is preferably applied multicolored, in particular in the form of a color progression, color gradient or as a true-color image.

As the first printed layer 12 is applied flat, high-resolution and sharply defined color progressions, gradients or true-color images can thus be generated.

The first printed layer 12 is preferably applied using gravure printing in the form of a grid, in particular a line grid with 60 lines/cm to 120 lines/cm and/or a line depth of from 15 μm to 45 μm.

Alternatively, the first printed layer 12 can be applied in the form of a grid, in particular a diagonally crossed grid with a grid width of from 40 ink cells/cm to 100 ink cells/cm and/or a depth of from 15 μm to 45 μm.

Alternatively, the first printed layer 12 can be applied by screen printing, in particular with a mesh size of from 90 T to 140 T or 90 S to 140 S.

Grids with a minimum dot size of 75 μm and a minimum dot spacing of 10 μm can be realized both using gravure printing and using screen printing.

The first printed layer 12 thus provides the coloring of the resulting motif desired in the final multilayer body 1, but does not yet have the final contour of this motif.

Figure 4:
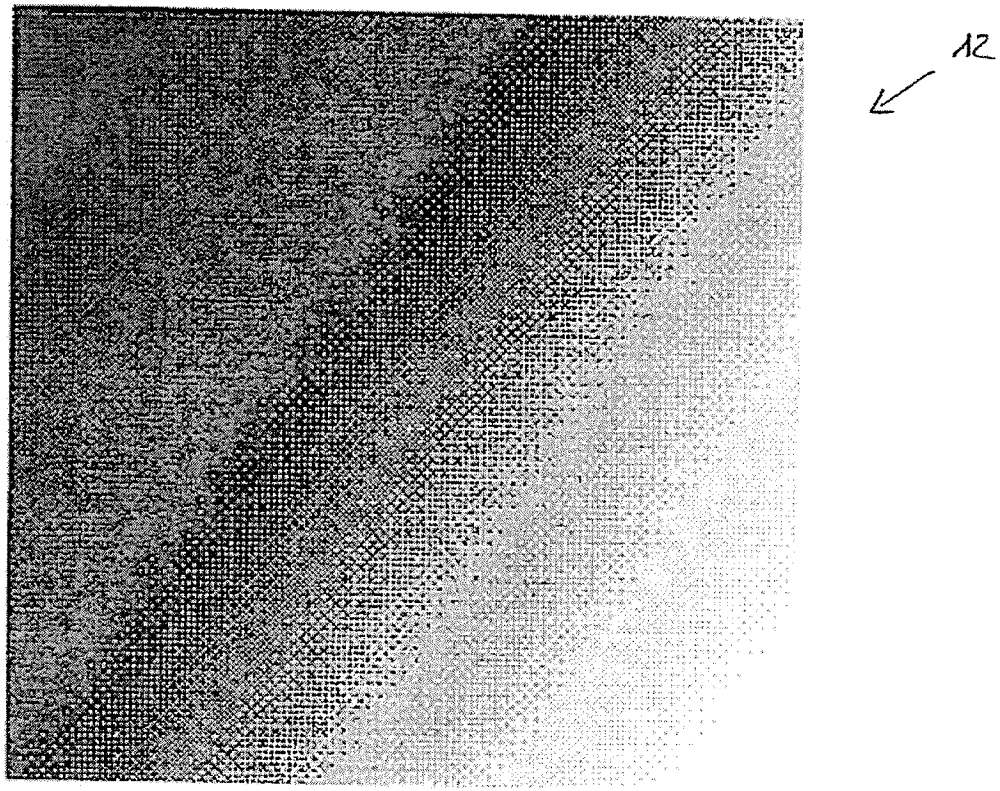
FIG. 4 a schematic top view of a first printed layer of an embodiment example of a multilayer body before the structuring.
Figure 7:
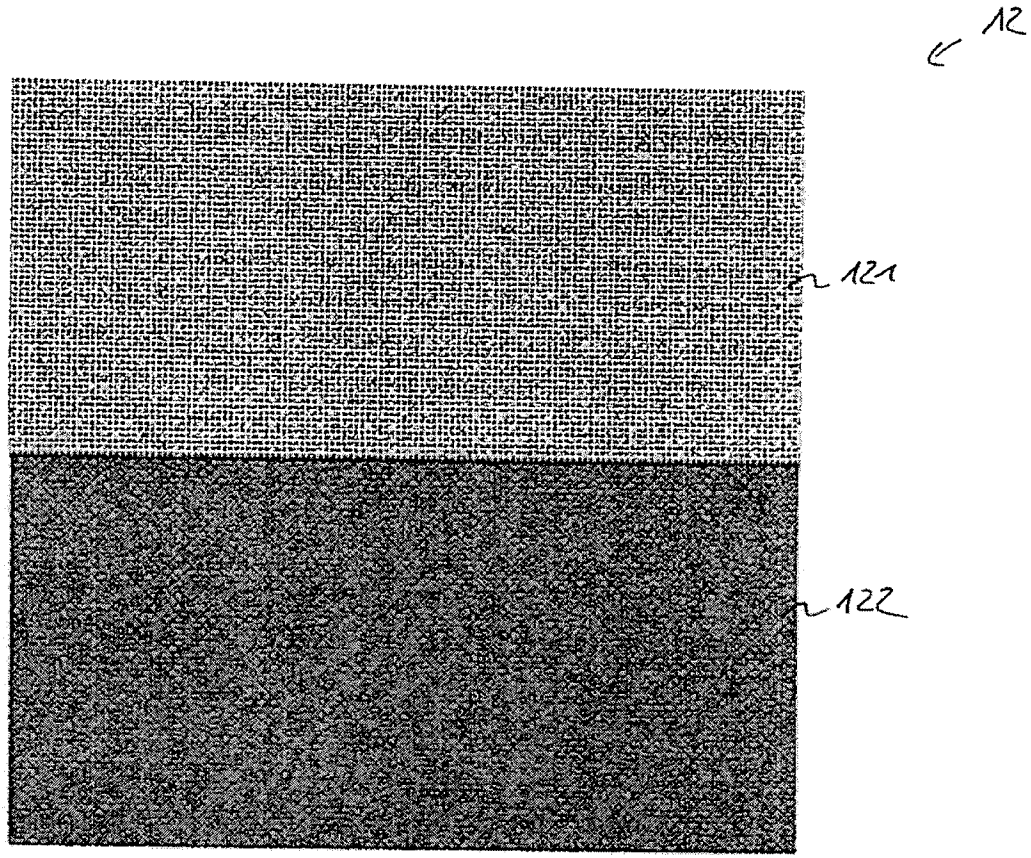
FIG. 7 a schematic top view of a first printed layer of a further embodiment example of a multilayer body before the structuring.

Two examples of the design of the first printed layer 12 are shown in FIGS. 4 and 7.

In the embodiment example according to FIG. 4, the printed layer 12 has a color gradient which runs diagonally over the printed surface.

In the embodiment example according to FIG. 7, the first printed layer 12 comprises a first partial area 121 and a second partial area 122. In both partial areas 121, 122, the varnish used comprises a pigment visible in the visible spectral range and/or a dyestuff, as well as dyes fluorescing under ultraviolet light. A motif recognizable in ultraviolet light (UV light) which is also recognizable in visible light is thereby created.

However, the pigments and/or dyestuffs visible in the visible spectral range are preferably to be admixed in only a small proportion in order not to weaken the luminescence of the UV-luminescent pigments and/or dyestuffs in UV light too much. The pigments and/or dyestuffs visible in the visible spectral range are usually black in UV light, i.e. absorb the UV light, and thereby weaken the UV luminescence of neighboring UV-luminescent pigments and/or dyestuffs in the varnish.

In the first partial area 121 and in the second partial area 122, in each case, a UV ink can be mixed into a different visible pigment and/or dyestuff, with the result that the polychromatism of the motif also appears correspondingly under UV light, but also appears in different colors under visible light.

However, it is also possible to mix the same visible pigments and/or dyestuffs into all UV inks, with the result that a monochromatic motif results in visible light, which appears multicolored only in UV light.

Figure 2:
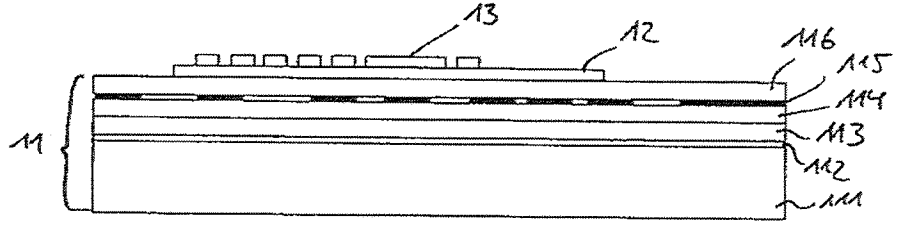
FIG. 2 a second intermediate product during the production of an embodiment example of a multilayer body in a schematic sectional representation.

After the application of the first printed layer 12, a second printed layer 13 is applied to the first printed layer 12. This is represented in sectional representation in FIG. 2 and in top view in FIGS. 5 and 8.

Figure 5:
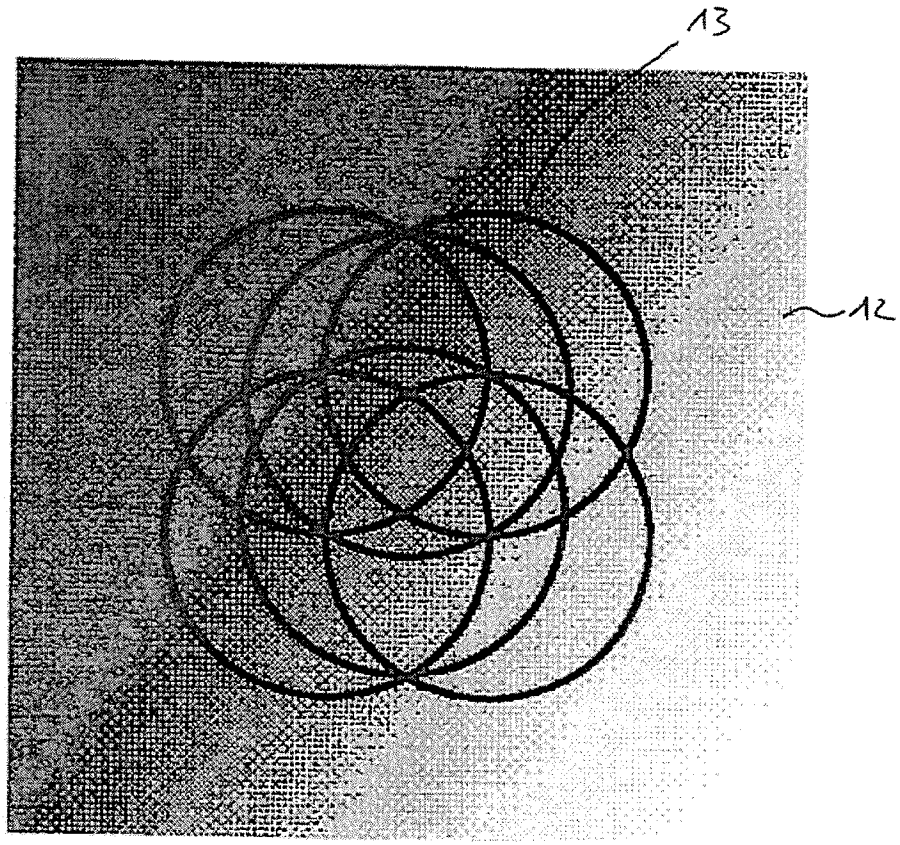
FIG. 5 a schematic top view of a first and second printed layer of an embodiment example of a multilayer body before the structuring.
Figure 8:
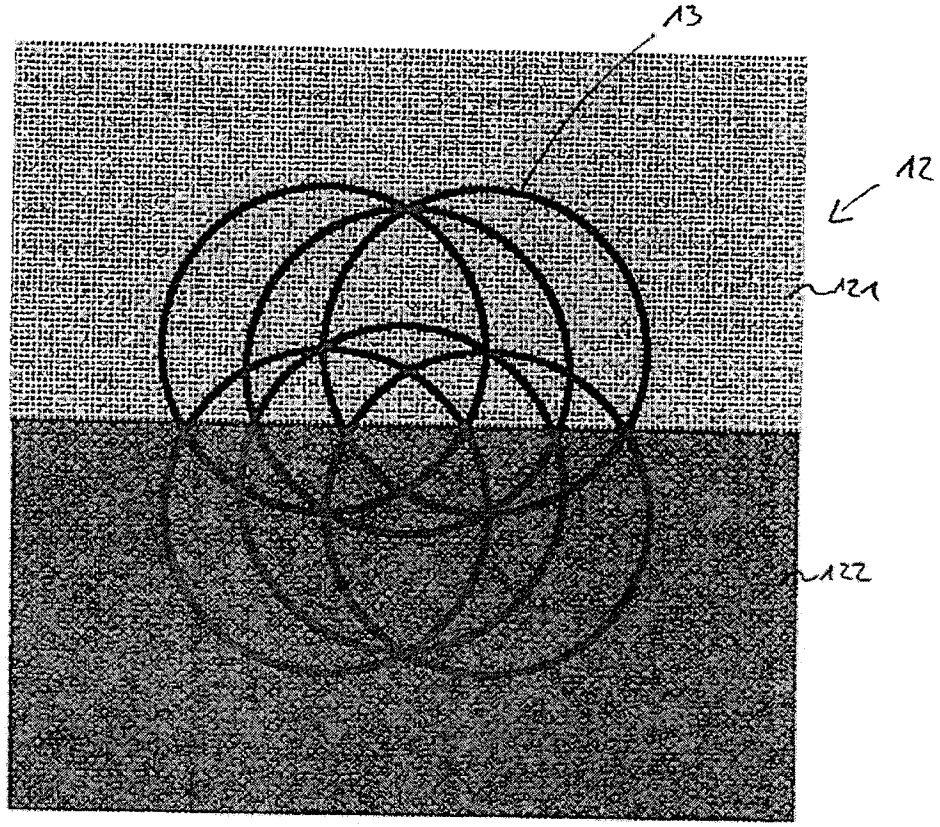
FIG. 8 a schematic top view of a first and second printed layer of a further embodiment example of a multilayer body before the structuring.

Unlike the first printed layer 12, the second printed layer 13 is printed monochromatically, thus in full tone. Fine line structures, such as for example guilloche patterns, can thereby be realized. In FIGS. 5 and 8 the printed layer 13 is shown opaque and black merely for the purpose of representation. The printed layer 13, however, can also be dyed transparent, translucent, or transparent or translucent.

Here too, the printing can be effected using gravure printing or screen printing. During the printing of the second printed layer 13, a minimum line thickness of 80 μm with a minimum line spacing of 100 μm can be achieved.

The varnish used for the printing of the second printed layer 13 is, for example, a solvent-based varnish made of a PVC mixed polymer of vinyl chloride, vinyl acetate, dicarboxylic acid and a crosslinker, e.g. polyisocyanate or polyaziridine. Alternatively, varnish made of polyester and cellulose propionate and a crosslinker can also be used. If such a varnish is applied to the above-described acrylic varnish used for the printing of the first printed layer 12, this crosslinker reacts with the acrylic acid in this varnish and thereby makes the latter alkali-resistant and thus resistant to a subsequent etching step.

The printing of the second printed layer 13 is followed by a treatment with a preferably alkaline etchant, for example with alkali hydroxide (NaOH) or alkali carbonate ($Na_2CO_3$).

It is advantageous if the alkaline etchant is used in a concentration of from 0.5% to 3%, and/or at a temperature of from 20° C. to 50° C., and/or for a period of from 0.5 s to 5 s.

Additionally, the etching process can be promoted by agitating the etchant, targeted flow of the etchant against the first printed layer, sonication, brushing and/or smearing.

Figure 6:
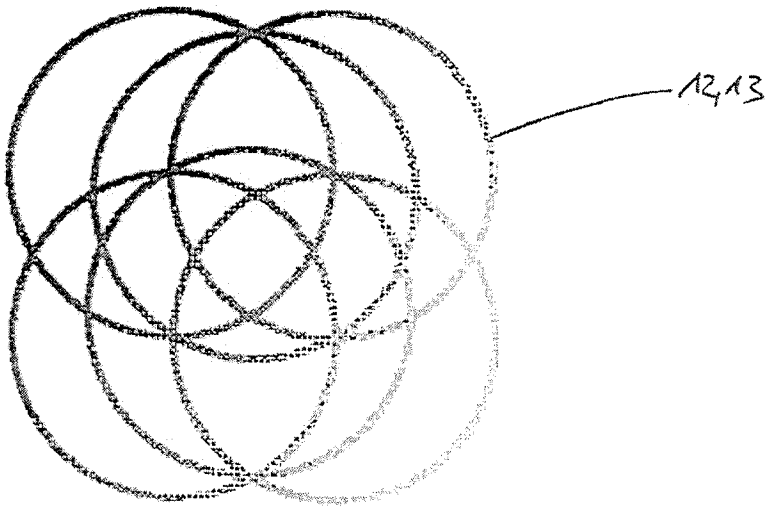
FIG. 6 a schematic top view of a first and second printed layer of an embodiment example of a multilayer body after the structuring.
Figure 9:
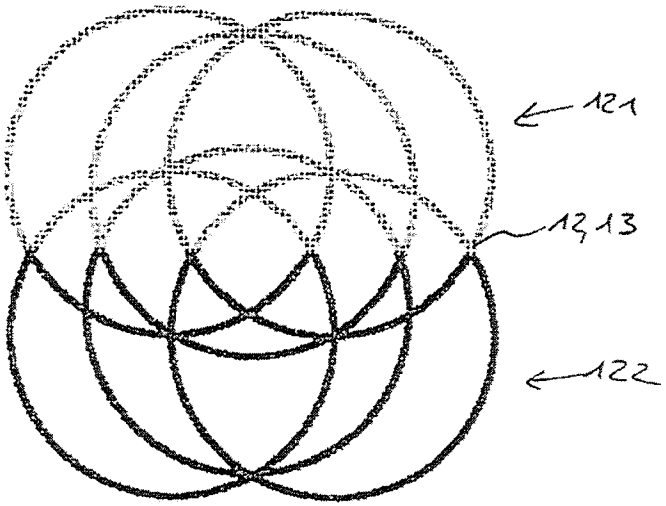
FIG. 9 a schematic top view of a first and second printed layer of a further embodiment example of a multilayer body after the structuring.

Through this treatment, the first printed layer 12 is removed completely and with defined edges in the areas in which it is not covered by the second printed layer 13. The multilayer body 1 shown in cross section in FIG. 3 and in top view in FIGS. 6 and 9 is thus obtained.

The first printed layer 12 thus provides the final coloring of the printed motif, while the contour of the motif is defined by the second printed layer 13 and the etching step. High-resolution multicolored line patterns with defined edges can thus be generated.

It is likewise possible to invert the sequence of the production steps and to mold and structure the printed layers 12 and 13 first. The layer composite 11 is then subsequently applied to the printed layers 12, 13.

However, care is to be taken that, before the application of the layer composite 11, a height-compensation layer should be provided, so that any height differences present in the partial printed layers 12, 13 do not impede subsequent process steps, in particular a replication.

In this case, it is then also possible to use the thus-created motif made of the printed layers 12, 13 as a mask for a further exposure step. A prerequisite for this is merely that the motif is partially impermeable for the exposure radiation, through the use of pigments, dyestuffs and/or transparent blockers, in particular UV blockers. In particular, UV-luminescent pigments and dyestuffs which can already be provided in the printed layers 12, 13 absorb the UV radiation and thus advantageously already act in this way as UV blockers during a subsequent exposure.

It would thus be possible, for example, to apply a replication layer 114 and mold a surface relief after the structuring of the printed layers 12, 13. A metal layer 115 can then be applied, for example by vapor deposition, sputtering, chemical vapor deposition or the like.

To this metal layer 115 a photoresist is then applied and exposed from sides of the motif formed by the printed layers 12 and 13 through the motif and the metal layer 115.

During the subsequent developing of the photoresist, the non-crosslinked/exposed portions of the photoresist are removed. This thus now covers the metal layer 115 congruent and registered relative to the printed layers 12 and 13. The metal layer can now be partially demetalized in a further etching step, with the result that the metal is likewise present congruent with the printed layers 12, 13.

A partial metal layer 115 is thereby obtained which is molded perfectly registered relative to the motif formed by the printed layers 12, 13. The metal layer 115 can strengthen the optical effect of this motif during irradiation with UV light, as the metal layer 115 itself appears black in UV light and thus increases the optical contrast and at the same time reflects portions of the UV light back into the printed layers 12, 13 on the rear side.

The optical effect of the multilayer body 1 can furthermore be significantly modified by combining the printed layers 12, 13 with layers which are transparent in the visible range, but block specific spectral ranges in the UV range. This makes sense in particular if the printed layer 12 contains UV-fluorescent dyes.

For example, a PET film blocks the spectral range below a wavelength of 310 nm. Thus the optical effect can, e.g., look different during excitation of the dyes in the printed layer 12 with a light wavelength of 365 nm from the front side and with a light wavelength of 254 nm from the rear side of the multilayer body 1.

However, it is likewise also possible to print corresponding transparent varnishes with UV blockers in a further motif such that the optical effect of the printed layer 12 only becomes visible in areas and depending on the UV wavelength.

The second printed layer 13 can optionally also have such a UV blocker. This can be, for example, benzophenone-6.

The second printed layer 13 can furthermore also be dyed with pigments and/or dyestuffs which are visible in the visible spectral range. An example is to print the first printed layer 12 with a translucent optically variable pigment such as for example Iriodin® from Merck or Lumina® from BASF.

The second printed layer 13 is then printed overlapping with the first printed layer 12 only in areas and the Iriodin is removed where the second printed layer 13 is not present.

The result is a motif in the color of the second printed layer 13 which is covered in areas with the Iriodin of the first printed layer 12. The Iriodin and the second printed layer 13 are arranged perfectly registered.

A metameric color effect results in which, depending on the viewing angle, the surfaces without Iriodin look almost identical or differ from each other at a different viewing angle because of the transparence and simultaneous optical variability of the Iriodin.

LIST OF REFERENCE NUMBERS

1 multilayer body
11 layer composite
111 carrier ply
112 detachment layer
113 protective layer
114 replication layer
115 metal layer
116 protective layer
12 first printed layer
121 first area
122 second area
13 second printed layer

The invention claimed is:

1. A method for producing a multilayer body, comprising:

a) providing a first printed layer;

b) partially applying a second printed layer to the first printed layer;

c) structuring the first printed layer using the second printed layer as a mask, whereby areas of the first printed layer which are not covered by the second printed layer are removed leaving areas of the first printed layer covered by the second printed layer to form a motif having areas of the first printed layer covered by the second printed layer formed in a substantially congruent relationship with the second printed layer after the structuring of the first printed layer; and d) applying a layer composite to the motif, the layer composite being applied to at least one of the areas of the first printed layer covered by the second printed layer or the second printed layer after the structuring of the first printed layer using the second printed layer as a mask, the layer composite comprising one or more of the following layers: a carrier ply, a replication layer with a surface relief, a reflective layer, a protective layer, a volume hologram layer, wherein the multilayer body comprises the motif, and wherein, to provide the first printed layer, a first varnish is used which reacts chemically, in a crosslinking reaction, with a second varnish used for the application of the second printed layer, and wherein the second varnish is a PVC mixed polymer of vinyl chloride, vinyl acetate and dicarboxylic acid, or wherein the second varnish is a polyester varnish with cellulose propionate.

2. The method according to claim 1, wherein the first varnish is a water-based or solvent-based alkali-soluble varnish.

3. The method according to claim 1, wherein the first varnish comprises at least one of the following: colored pigments, achromatic pigments, effect pigments, UV-excitable fluorescent pigments, thin-film systems, cholesteric liquid crystals, dyestuffs, metallic nanoparticles, non-metallic nanoparticles.

4. The method according to claim 1, wherein the second varnish is a PVC mixed polymer of vinyl chloride, vinyl acetate and dicarboxylic acid.

5. The method according to claim 1, wherein the second varnish is a polyester varnish with cellulose propionate.

6. The method according to claim 1, wherein the second varnish comprises polyisocyanate and/or polyaziridine.

7. The method according to claim 1, wherein the first printed layer is structured by the action of an alkali etchant comprising alkali hydroxide or alkali carbonate.

8. The method according to claim 7, wherein the alkaline etchant is used in a concentration of from 0.5% to 3%, and/or at a temperature of from 20° C. to 50° C., and/or for a period of from 0.5 s to 5 s.

9. The method according to claim 1, wherein the first printed layer is applied multicolored in the form of a color progression, color gradient or true-color image.

10. The method according to claim 1, wherein the first printed layer is applied in the form of a line grid with 60 lines/cm to 120 lines/cm and/or a line depth of from 15 μm to 45 μm.

11. The method according to claim 1, wherein the first printed layer is applied in the form of a diagonally crossed grid with a grid width of from 40 ink cells/cm to 100 ink cells/cm and/or a depth of from 15 μm to 45 μm.

12. The method according to claim 1, wherein the first and/or second printed layer is applied by gravure printing.

13. The method according to claim 1, wherein the first and/or second printed layer is applied by screen printing, with a mesh size of from 90 T to 140 T or 90 S to 140 S.

14. The method according to claim 1, wherein the second printed layer is applied in the form of a graphic motif, alphanumeric character, logo, image, or guilloche pattern.

15. The method according to claim 1, wherein the layer composite is applied to the at least one of the first printed layer or the second printed layer after the step of structuring the first printed layer using the second printed layer as a mask.

16. The method according to claim 15, wherein the layer composite comprises at least one varnish layer with a UV blocker.

17. The method according to claim 16, wherein the varnish layer with the UV blocker is applied in the form of a graphic motif, alphanumeric character, logo, image, or guilloche pattern.

18. The method according to claim 1, wherein, before the application of the layer composite, a height-compensation layer of a varnish made of a combination of butyl acrylate and PMMA with a layer thickness of from 0.5 μm to 3 μm is applied to the first and/or second printed layer.

19. The method according to claim 1, wherein the layer composite comprises a reflective metal layer, the reflective metal layer comprising at least one of the following: aluminum, copper, chromium, silver, gold and alloys thereof, and the method further comprises:

structuring the reflective metal layer of the layer composite using the second printed layer as a mask.

20. The method according to claim 19, wherein, for the structuring of the metal layer, a photoresist layer is applied to the metal layer, is exposed from the side of the second printed layer and is removed in the exposed areas during the developing.

21. The method according to claim 20, wherein, after the developing of the photoresist layer, the metal layer is structured by etching.

22. The method according to claim 20, wherein the first and/or second printed layer comprises a UV blocker, which absorbs UV light in a wavelength range in which the photoresist layer is exposed.

23. A method for producing a multilayer body, comprising:

providing a layer composite having one or more of the following layers: a carrier ply, a replication layer with a surface relief, a reflective layer, a protective layer, a volume hologram layer;

applying a first printed layer to a surface of the layer composite;

partially applying a second printed layer to the first printed layer;

structuring the first printed layer using the second printed layer as a mask, whereby areas of the first printed layer which are not covered by the second printed layer are removed leaving areas of the first printed layer covered by the second printed layer so that areas of the first printed layer covered by the second printed layer are formed in a substantially congruent relationship with the second printed layer after the structuring of the first printed layer, wherein the multilayer body comprises the areas of the first printed layer covered by the second printed layer, the second printed layer and the layer composite, and wherein, to provide the first printed layer, a first varnish is used which reacts chemically, in a crosslinking reaction, with a second varnish used for the application of the second printed layer, and wherein the second varnish is a PVC mixed polymer of vinyl chloride, vinyl acetate and dicarboxylic acid, or wherein the second varnish is a polyester varnish with cellulose propionate.

* * * * *